US005855155A

United States Patent [19]

Weissenberger et al.

[11] Patent Number: 5,855,155

[45] Date of Patent: Jan. 5, 1999

[54] APPARATUS FOR PRODUCING MOUNTS FOR PICTURES OR DOCUMENTS

[75] Inventors: Ulf Weissenberger; Andreas Weissenberger, both of Rebstein, Switzerland

[73] Assignee: Weissenberger AG, Rebstrein, Switzerland

[21] Appl. No.: 445,866

[22] Filed: May 22, 1995

Related U.S. Application Data

[63] Continuation of Ser. No. 151,804, Nov. 15, 1993, abandoned.

[30] Foreign Application Priority Data

Apr. 12, 1992 [DE] Germany ..... 42 40 933.0

[51] Int. Cl.[6] ..... B26D 3/02; B26D 5/02

[52] U.S. Cl. ..... 83/76.9; 87/76.1; 87/581

[58] Field of Search ..... 83/76, 940, 941, 83/938, 460, 461, 699.51, 699.61, 581, 76.1, 76.5, 76.7, 76.8, 76.9

[56] References Cited

U.S. PATENT DOCUMENTS 5,388,488 2/1995 Geidl et al. ..... 83/581

*Primary Examiner*—Rinaldi I. Rada

*Assistant Examiner*—Allan Schrock

*Attorney, Agent, or Firm*—Laurence R. Brown

[57] ABSTRACT

An apparatus for producing mounts for pictures or documents comprises a cutting head which is movable over a mount blank in a longitudinal axis and in a transverse axis. A controller is provided which is so designed that the cutting head is automatically movable over the mount blank to be cut. The controller is adjustable such that the cutting head is moved according to the size of the over-cut required with a predetermined thickness of the mount blank over the greater distance required for obtaining the desired width of the mount cut-out. The oblique cut edges, meeting in the corners, of the interior, to be removed, of the mount blank are completely severed without the cut being greater than necessary. The individual cut edges can be cut precisely and easily with this apparatus. It is therefore possible even for operators who are not very skilled practically to produce a relatively large number of greatly different mounts within a short period of time.

7 Claims, 4 Drawing Sheets

APPARATUS FOR PRODUCING MOUNTS FOR PICTURES OR DOCUMENTS

This application is a continuation of application Ser. No. 08/151,804, filed Nov. 15, 1993, now abandoned.

FIELD OF THE INVENTION

The present invention relates to an apparatus for producing mounts for pictures or documents.

BACKGROUND OF THE INVENTION

Various apparatuses for producing a mount, i.e. a cardboard frame for receiving a picture or a document, are known. They all have the common feature that the mount blank fixed on a base plate can be cut by means of an oblique blade capable of travelling along a rail. In the former apparatuses, it is usually possible to cut only along a single axis, the cutting operation necessary for cutting out the frame taking place in a second axis at right angles to the first axis in such a way that the mount blank has to be released and turned through 90°.

In order to cut out a mount frame, the above-mentioned rail has two adjustable stops which have to be shifted and fixed along the rail according to the desired size of the mount cut-out. The rail has a millimeter scale for this purpose. Once this adjustment has been made, the carriage carrying the blade is pushed manually to the second stop beginning at the first stop, the blade being pressed downwardly into the cardboard. As the cut edges of a mount cut-out are oblique and these oblique cut edges meet one another in the frame corners, this work demands some skill to achieve an attractive result.

In addition, the blade has to issue with a point so that it can penetrate the cardboard at the beginning of a cut. This means that the cutting edge of the blade is inevitably oblique, i.e. extends diagonally as viewed from the side. It is difficult to make a cut from a desired starting point to a desired end point. To enable this cut to be located, as proposed and in adaptation to the respectively parallel cut on the opposite side of the frame, the diagonal cutting edge of the blade has to be moved out by a certain amount beyond the established cut end, at least in the end region of the cut, in order to sever the cardboard completely. It is not easy for an inexperienced operator to find the correct amount of over-cut here. An excessively large cut should not be made either, as the over-cut would be visible on the finished mount. The over-cut required is considerably complicated in that the corresponding amount of over-cut depends on the thickness of the respective cardboard to be cut. The thicker the cardboard, the great the over-cut has to be. If various mounts with different cut edges are also to be produced, i.e. for example on the one hand with a cut angle of 40° and, on the other hand, with a cut angle of 60° so that the cutting face of the oblique cutting edge visible on the finished mount changes, a further problem arises during the cutting work. From the foregoing it will be seen that the production of a mount, on the one hand, demands some experience as well as practical skill and, on the other hand, is time-consuming, making fast, economic work for the professional production of a large number of mounts difficult.

SUMMARY OF THE INVENTION

The object of the present invention is accordingly to provide an apparatus for producing a mount for pictures or documents with which the described drawbacks of former apparatuses of this type are avoided and more exact cuts as well as considerably faster work are possible.

Accordingly, the present invention provides apparatus for producing mounts for pictures or documents, in which an arrangement is provided by means of which a cutting head having a cutting blade arranged thereon is movable over the mount blank in a longitudinal axis and in a transverse axis, with respect to the mount to be cut, in order to cut out the mount without the mount blank having to be released between the individual cutting processes, means being provided for establishing the size of the over-cut to be cut in addition to the width of the mount cut-out by the blade of the cutting head at the beginning and end of a cut edge, to enable the interior of the mount blank which is to be removed to be severed completely in the case of the oblique cut edges meeting one another in the corners, as a function of the respective thickness of the mount blank.

This apparatus is suitable for professional work. It is capable of cutting in the direction of the longitudinal as well as the transverse axis of the mount block without the mount blank having to be released and turned therebetween. In particular, the individual cut edges can be cut precisely and easily even in the case of respectively thicker or thinner cardboard. Even cut edges having different inclinations can be mastered. It is therefore possible, even for operators who are not practically very skilled, to produce a relatively large number of the most varied mounts within a short period of time.

BRIEF DESCRIPTION OF THE DRAWINGS

The invention will now be described in detail, by way of example, with reference to the drawings, in which.

DESCRIPTION OF PREFERRED EMBODIMENTS

Figure 1:
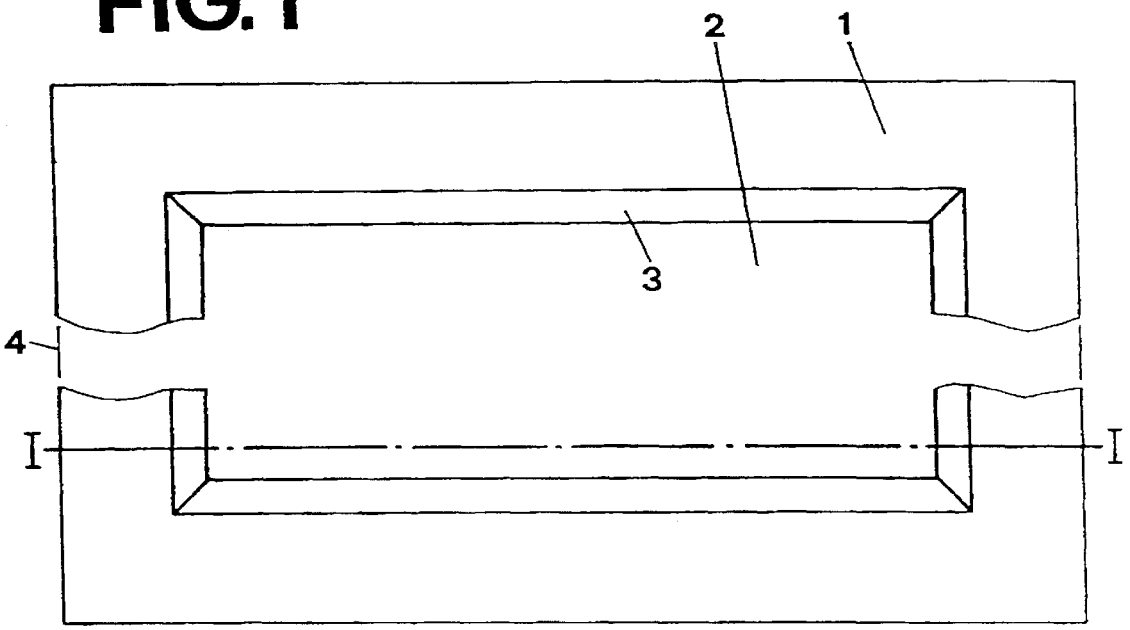
FIG. 1 is a view of one embodiment of a finished mount produced by an apparatus according to the invention.
Figure 2:
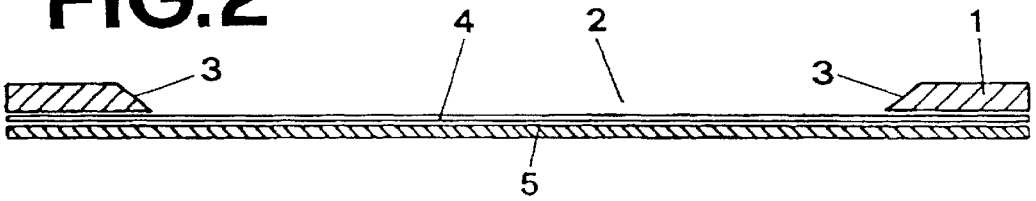
FIG. 2 is a section taken along the line I—I in FIG. 1 in the direction of the arrows.

As shown in FIGS. 1 and 2, a mount 1 is a frame made of cardboard with a window-like cut-out 2 having oblique cut edges 3. The picture 4 and optionally a rear wall 5 serving as a reinforcement are then arranged behind or below the mount 1. The assembly is usually fastened behind a pane of glass in a picture frame.

Figure 3:
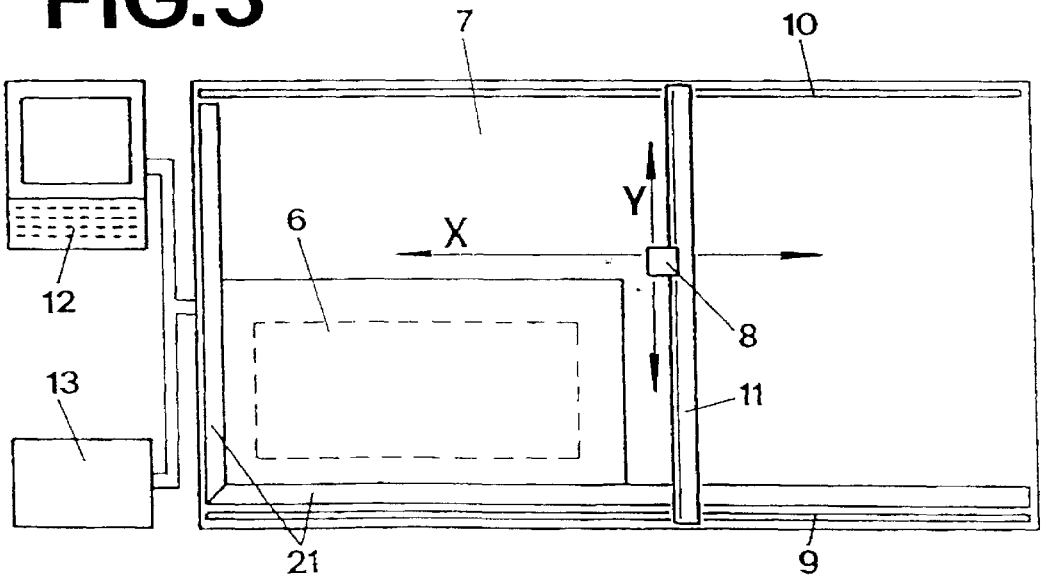
FIG. 3 is a schematic view of one embodiment of an apparatus according to the invention.

According to FIG. 3, the apparatus for producing mounts has a base plate 7 which receives a mount blank 6. Located over the base plate 7 is an arrangement by means of which a cutting head 8 can be moved over the mount blank 6 in a longitudinal axis X and in a transverse axis Y for cutting out the mount. This arrangement consists here of two rails 9 and 10 which each extend along an opposing longitudinal edge of the base plate 7 and on which rails 9 and 10 there can travel a beam 11 which, in turn, carries a carriage which is capable of travelling along its longitudinal axis and on which the cutting head 8 is fastened. The apparatus also has a control arrangement 12, which allows automatic operation for the first time, and a pneumatic arrangement 13 the purpose of which will be described hereinafter.

Figure 4:
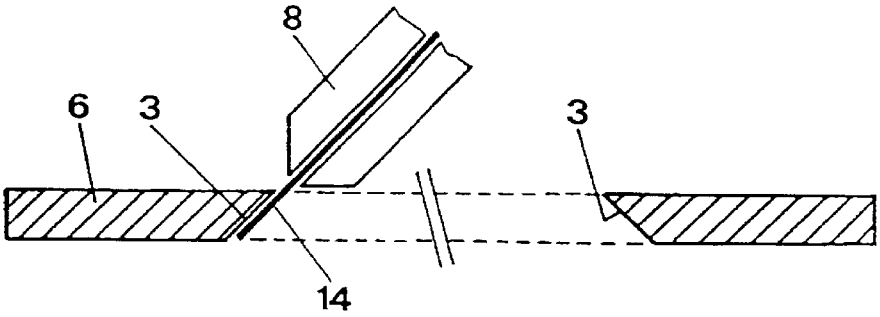
FIG. 4 shows the manner of cutting a mount using an oblique blade.

As shown in FIG. 4, the mount blank 6 is preferably cut from its back. In this way, any damage and scratches on the subsequently visible front of the mount which might be caused by the cutting head 8 moving over it and by the clamping arrangement for fixing it on the base plate are avoided. FIG. 4 also shows particularly clearly how the oblique cut edge 3 can be achieved by means of the oblique blade 14. This oblique position of the blade 14 or of the cutting head 8 is preferably adjustable or attainable by insertion of a different cutting head 8 so that the mounts having a variety of appearances can be produced. The blade is shown here in the case of cutting along the Y axis in FIG. 3.

Figure 5:
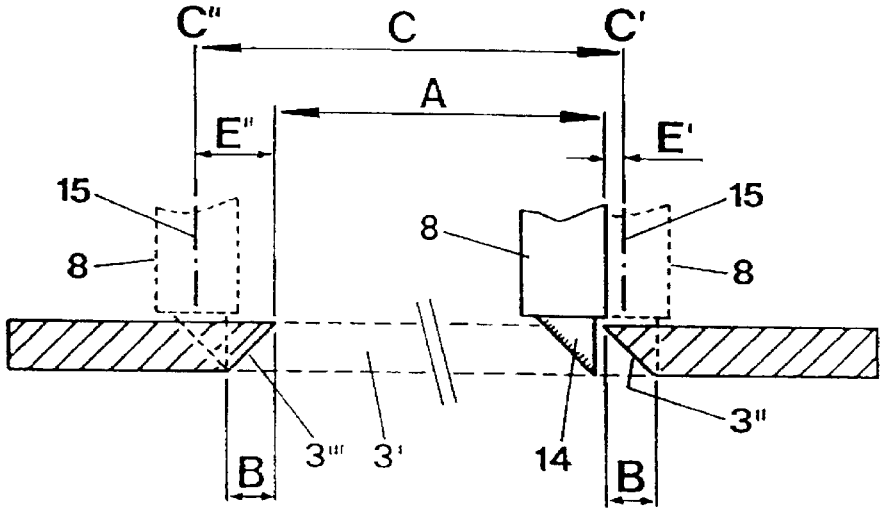
FIG. 5 shows the amount of over-cut required when cutting a mount.
Figure 6:
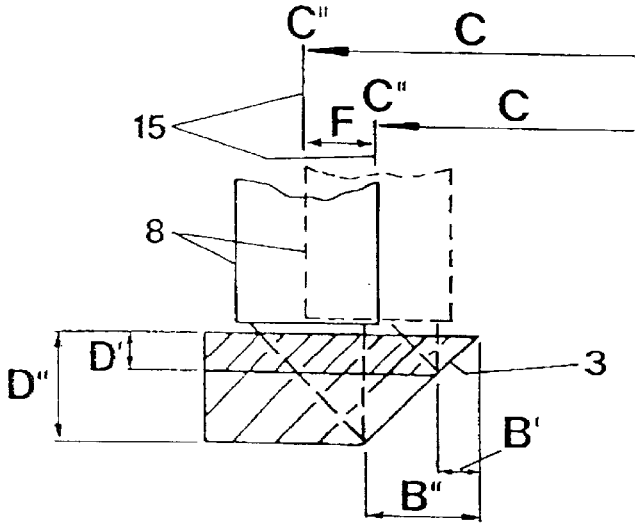
FIG. 6 shows how the amount of over-cut changes according to the thickness of the cardboard.

FIGS. 5 and 6 show the particular problems in the cutting of mounts and the mode of operation of the apparatus according to the invention.

FIG. 5 shows the cutting head 8 and the blade 14 from a different perspective which is turned through 90° relative to the illustration in FIG. 4, i.e. in the case of cutting along the X axis in FIG. 3. The corresponding cut edge 3' is indicated in broken lines. On the other hand, the two other cut edges 3" and 3'" which form the beginning and the end of the cut edge 3' and are at an angle of 90° from the cut edge 3' are shown clearly. The width of the mount cut-out to be cut is designated by A, whereas the width of the cut edges 3" and 3'" is designated by B in each case. As shown in FIG. 5, the blade 14 has to be moved over a greater distance than the desired width A of the mount cut-out owing to the oblique cut edges 3" and 3'" on either side of the cut edge 3' to be cut. This distance corresponds at least to the amount B+A+B. The width B of the oblique cut edges 3" and 3'" corresponds to the necessary amount of over-cut. With respect to the central axis 15 of the cutting head 8 which is eventually to be shifted by the apparatus, the cutting head 8 has to be moved over the distance C, as shown in broken lines, in order to obtain the mount cut-out A. Not only is this distance C greater than the width A of the mount cut-out, but it also lies asymmetrically to this width A. The starting position C' of the central axis 15 of the cutting head 8 is located somewhere in the region of the width B of the cut edge 3", whereas the end position C" is located on the other side of the width B of the opposing cut edge 3'". With respect to the central axis 15 of the cutting head 8, this apparatus should therefore be designed such that the factor E' is added to the determined width A of the mount cut-out at the beginning of the cut and the factor E" at the end of the cut. The distance C to be covered by the cutting head 8 therefore corresponds to E'+A+E", the beginning of this distance C being located before the beginning of the intended mount cut-out A by the factor E'.

It should be noted that the width B of the cut edges 3" and 3'" is dependent on the one hand on the thickness of the cardboard and on the other hand on the cut angle. Therefore, the width B is not a uniform size but can vary considerably from one mount to another.

Furthermore, the blade 14 has to be relatively thin to obtain optically attractive cut edges 3. If it were to project more than necessary from the cutting head 8, it could become distorted during cutting, producing an irregular cut. The cutting head 8, or optionally a guide arranged thereon, should almost rest on the cardboard to be cut. The blade 14 must therefore project to a greater or lesser extent from the cutting head 8 depending on the width of the cardboard.

FIG. 6 shows how the distance C of the cutting head 8 changes with different thicknesses of cardboard D' and D". The width B' or B" of the cut edge 3 therefore varies considerably. Furthermore, a variation in the cutting angle is not allowed for in this illustration. A flatter cut angle is often desired with thinner cardboard so that an optically improved mount is nevertheless obtained. The effect of a thicker, more expensive cardboard is thus to be achieved. In any case, the end position C" of the cutting head 8 has to be shifted by a certain factor E. This factor E is derived from the thickness of the cardboard and possibly additionally from the cut angle. The starting position C' according to FIG. 5 is also displaced similarly to the displacement, shown here, of the end position C". With respect to the central axis 15 of the cutting head 8, the starting position C' even shifts by a different amount than the end position C".

In the embodiment according to FIG. 3, the apparatus according to the invention is designed, as already mentioned, such that the cutting head 8 is not usually moved manually as in the past but automatically by the control arrangement 12. With the design of this apparatus, recourse cannot be had to experiences with other types of automatically operating cutting apparatuses because the problem of the meeting cut edges arises only in the cutting of mounts. Automatic operation of the apparatus is possible only if the many possible amounts of over-cut required with the different thicknesses of cardboard and cut angles are determined or calculated and programmed into the controller 12. It can be appreciated on the basis of the foregoing comments that the fulfilment of this object entails considerable effort in thought and calculations. However, this effort has to be exerted once for producing the apparatus according to the invention. It should be noted that the setting up of the theory concerning the distances to be covered by the cutting head 8 gives rise, specifically for an automatically operating apparatus, to a notion by means of which the problem mentioned at the outset of the application of exact cuts can be mastered. Using a keyboard on the controller 12 it is accordingly possible to input the amount of the desired mount cut-out together with the thickness of the mount blank placed onto the base plate 7. The apparatus is accordingly capable of perfectly determining and travelling the cutting distances required for obtaining the desired mount cut-out. The beam 11 and the cutting head 8 capable of travelling on it in the manner of a carriage is correspondingly moved on by the controller 12 without further manipulation being necessary for this purpose. To allow cutting along the X and Y axes, the cutting head 8 has to be rotatably mounted. Similarly, it must be lowerable at the beginning of the cut and raisable again at the end of the cut. Finally, the blade 14 has to perform a penetration movement obliquely downwardly into the cardboard and a return movement again. All these movements are to be controlled by the controller 12.

In contrast to the present embodiment, it would also be conceivable to design the cutting head 8 so as to be movable only in a single cutting axis, in which case means would have to be provided to turn the mount blank 6 through 90° to allow cutting with respect to the mount blank 6 but in both X and Y axes. The turning movement of the mount blank could be carried out, for example, by a turntable to be controlled by the controller 12. However, a design of this type is less useful.

Even a practically inexperienced operator can achieve an excellent cutting result using the apparatus according to the invention in accordance with the present embodiment. This can be achieved in a very much shorter operating period. The present apparatus therefore represents quite decisive progress over the formerly possible cutting of mounts by hand.

Extensive possibilities also arise owing to this apparatus. As a controller 12 on the one hand and a controllable cutting head 8 capable of travelling in two axes, X and Y, on the other hand are provided, it would also be conceivable to cut not only the internal edges, i.e. the mount cut-out, but also the external edges of the mount. A plurality of mounts could therefore be cut automatically from a large amount of cardboard with a corresponding control program. The formerly required preliminary cutting of the mount blanks 6 to the desired external size would therefore also be unnecessary. Furthermore, the cardboard could thus be utilised more economically.

Figure 9:
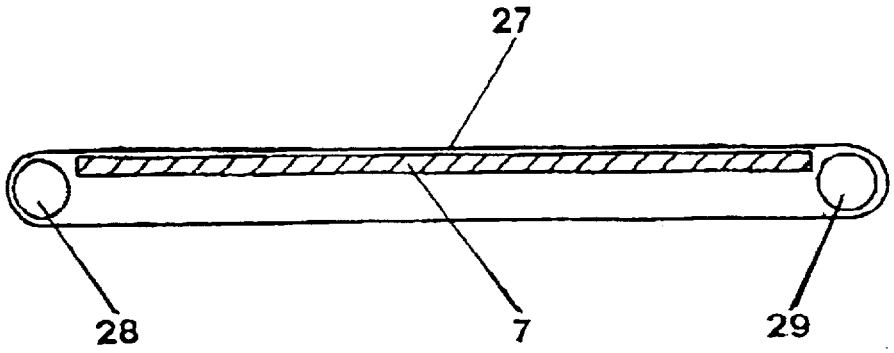
FIG. 9 is a vertical section through a flexible cutting support in the form of a continuous belt.
Figure 10:
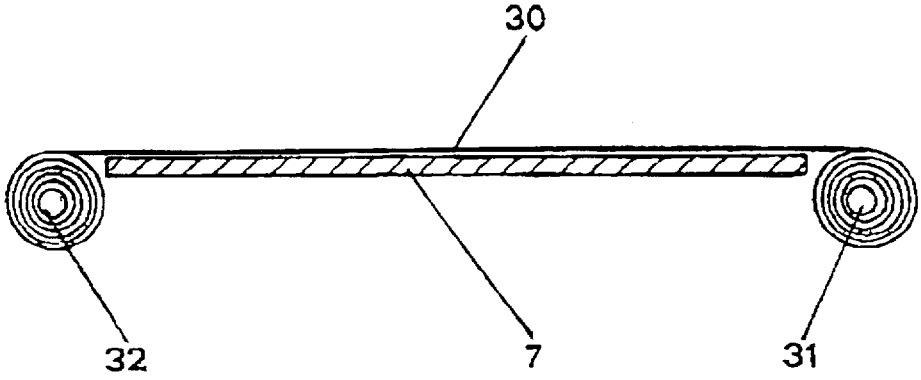
FIG. 10 is a vertical section through another form of flexible cutting support comprising a belt running from a supply roll to a drivable winding roll.

A cardboard normally lies on the base plate 7 which serves as a cutting support. A further improvement could be made by using a suitable rollable cutting support. For example, a felt-like cutting support would be conceivable. In that case, a roll could be provided on both sides of the base plate 7 so that the cutting support could be pulled over the base plate. The cutting support could be designed as a continuous belt 27 running over rollers 28 and 29 at each end of the base plate 7 and returning below the base plate, as shown in FIG. 9, the roller 28 being provided with drive means. Alternatively, as shown in FIG. 10, the belt 30 could run over the base plate 7 from a supply roll 31 onto a drivable winding roll 32. In both cases, it would be possible to arrange, before the base plate 7 in the operating direction, a preparation table from which the belt-form cutting support could automatically pull the cardboard to be cut onto the base plate. It would be even more useful to provide a delivery table onto which the ready cut mounts are then guided. The roll or rolls may be rotatable either manually or by a drive. It would be possible to allow the rolls to be controlled by the controller.

Figure 7:
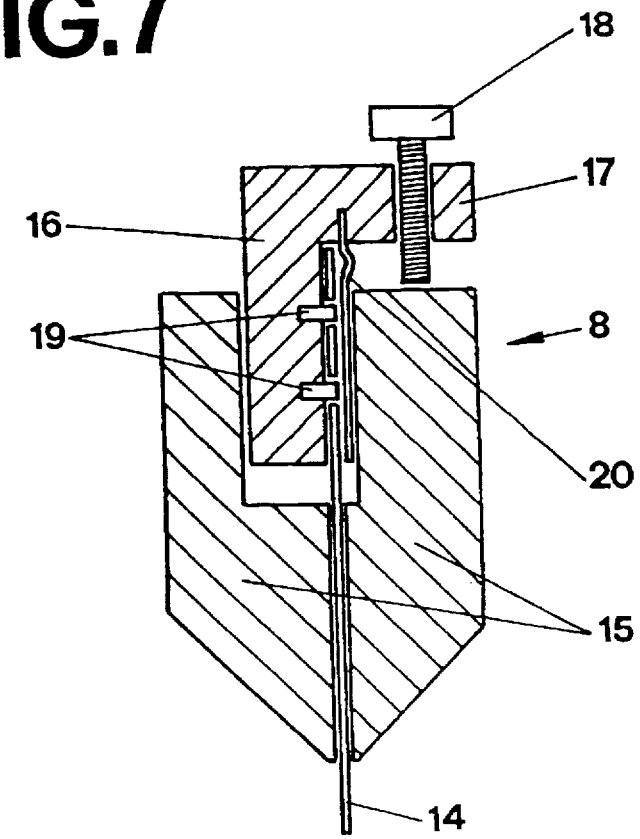
FIG. 7 shows a partial view of the cutting head with a cutting blade held therein.

The cutting head 8 in which the blade 14 is held will now be described in detail with reference to FIG. 7. In a known manner, the cutting head 8 has two clamping jaws 15 which clamp the blade 14. The blade 14 is detachably fastened on a blade mounting 16. This blade mounting 16 is provided with a stop 17 to ensure that the blade 14 does not project further than desired downwardly from the cutting head 8. In the present example, the stop 17 is provided with an adjusting screw 18 by means of which the depth of insertion of the blade may be adjusted. In this case, the blade 14 has two holes with which the blade can be placed onto two pins 19 on the blade mounting 16. The blade 14 is secured by means of a spring 20. However, the blade 14 could also be detachably fastenable on the blade mounting 16 in any other way; it is merely essential that it can be exchanged rapidly and without the aid of tools.

The purpose of the blade mounting 16 is as follows: during the cutting of mounts, the thin blade 14 becomes blunt relatively quickly and has to be exchanged. For this purpose, the clamping jaws 15 are released, the old blade is removed and a new one introduced. As already mentioned, it should be noted that the blade 14 projects downwardly from the cutting head 8 by a quite specific amount, depending on the thickness of the cardboard. This necessitates careful introduction of the blade. The present automatically operating apparatus cuts so rapidly that, in contrast to former manually actuable mount cutting apparatuses, half of the operating time would have to be employed for the frequent exchange of blades. Owing to the blade mount 16 it is now possible to insert a new blade 14 into a second blade mounting 16 while the apparatus operates automatically. As soon as it is necessary to exchange a blade, the prepared second blade mounting 16 can be inserted between the clamping jaws 15 without difficulty. The blade 14 automatically falls into the correct position owing to the stop 17. The apparatus can continue operating immediately. Therefore, the blade mounting 16 serves as an aid to introduction. The operating time is considerably accelerated owing to the blade mounting 16 together with the automatically operating apparatus.

Various blade mountings 16 may be provided for different thicknesses of cardboard, which then have a stop 17 which is of a different width or is arranged in a different way in each case. The size of the respective stop 17 then determines the cutting depth required for a specific thickness of cardboard. As shown in FIG. 7, however, a single design of the blade mounting 16 may suffice if it has the possibility of adjustment.

Figure 8:
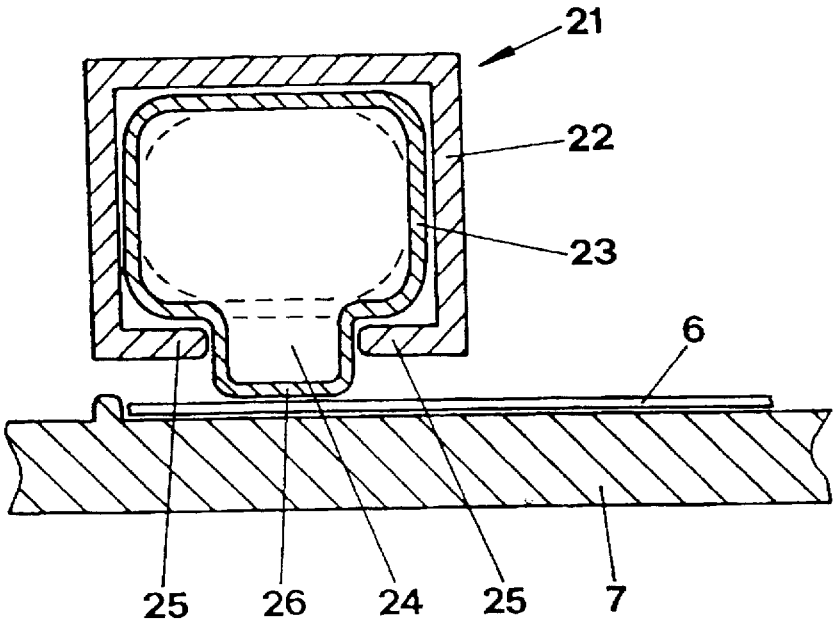
FIG. 8 shows a clamping arrangement for fixing the cardboard on a base plate.

Finally, FIG. 8 shows a clamping arrangement 21 for fixing the cardboard or the mount blank 6 on the base plate 7. The clamping arrangement 21 consists of a profile 22 which is C-shaped in cross-section and in which a flexible tube 23 is arranged. The C-shaped profile 22 is arranged with its orifice 24 at the bottom, i.e. in the direction of the base plate 7. The free ends 25 of the C-profile are pulled sufficiently far toward one another to prevent the tube 23 from falling out. The tube 23 can be inflated by means of the pneumatic arrangement 13 indicated in FIG. 3 and can therefore be brought from its rest position shown in broken lines in FIG. 8 into the clamping position. Owing to the inflation of the tube 23, the tube 23 substantially fills the interior of the profile 22, and also pushes, as far as possible, downwardly through the orifice 24 in the direction of the base plate 7. The bead 26 is formed on the tube 23. This bead 26 now clamps the mount blank 6 lying on the base plate 7. Like the other parts of the apparatus, the pneumatic arrangement 13 is preferably actuated via the controller 12. The particular advantage of this clamping arrangement is that the mount blank, i.e. the cardboard, is secured unmovably rigidly and also carefully. Owing to the tube 23, the edges of the cardboard are not pressed flat and scratches need not be feared. The clamping arrangement 21 is therefore eminently suitable for this purpose. It is also simple to produce.

We claim:

1. Apparatus for cutting substantially planar cardboard blanks to produce picture mounts with interior rectangular picture framing cut outs having edges beveled inwardly toward a picture viewing aperture without producing visible corner over cuts or under cuts, comprising in combination:

means for mounting a cardboard mount blank and releasably clamping said blank in a fixed position while cutting out said interior rectangular cut outs, a cutting head carrying a cutting blade thereon, means for mounting said cutting head and moving said cutting blade in a first longitudinal direction of the rectangular cut outs and in a second transverse direction of the rectangular cut outs with the blank clamped in said fixed position and with said cutting blade being disposed at an inclined angle with respect to the planar cardboard blanks at least during movement of the cutting head over said blank to cut said beveled edges about said picture viewing aperture wherein the edges meet one another in corners defining the rectangular cut outs and severing completely a portion of the cardboard blank, thereby producing the picture mount, and cutting head control means for establishing a length of overcut to define the corners, which overcuts extend beyond the picture viewing aperture to produce said corners without visible overcuts or undercuts, the length of the overcut being a variable function of the respective thickness of the mount blank and the magnitude of said inclined angle.

2. Apparatus as claimed in claim 1, in which said cutting head control means further comprise a controller and driving means controlled by the controller and arranged to move the cutting head automatically over the mount blank to be cut, the blade of the cutting head being moved according to the size of the interior region required with a predetermined thickness of the mount blank by the distance required for obtaining the desired width of the mount cut-out.

3. Apparatus as claimed in claim 2, in which the controller is arranged to control the movable cutting head in such a manner that, in addition to the interior region of the mount cut-out, the cutting head also cuts external edges of the mount, allowing a plurality of mounts to be cut automatically from a large amount of cardboard.

4. Apparatus as claimed in claim 1, in which a flexible cutting support is provided which is arranged to be guided by means of at least one drivable roller over a base plate, the cutting support comprising a belt running from a supply roll onto a winding roll whereby said belt can also be used to supply mount blanks to said means for mounting and releasably clamping the mount blank.

5. Apparatus as claimed in claim 1, in which the cutting head has two clamping jaws which are intended to clamp the blade, said blade being arranged on a blade mounting which is provided with a stop to ensure that the blade cannot penetrate further than desired downwardly from the cutting head, allowing the depth of cutting of the blade to be established.

6. Apparatus as claimed in claim 5, in which the stop is provided with an adjusting means, for example, with an adjusting screw, by means of which the depth of insertion of the blade and therefore the depth of cutting can be adjusted.

7. Apparatus as claimed in claim 1, in which a flexible cutting support is provided which is arranged to be guided by at least one drivable roller over a base plate, the cutting support comprising a continuous belt, said belt also serving to supply mount blanks to the means for mounting and releasably clamping the mount blank.

* * * * *